US010071013B2

(12) United States Patent
Allen

(10) Patent No.: US 10,071,013 B2
(45) Date of Patent: Sep. 11, 2018

(54) MASSAGER AND METHOD OF MAKING THE SAME

(71) Applicant: Thomas R. Allen, La Quinta, CA (US)

(72) Inventor: Thomas R. Allen, La Quinta, CA (US)

(73) Assignee: Thomas R. Allen, La Quinta, CA (US)

( * ) Notice: Subject to any disclaimer, the term of this patent is extended or adjusted under 35 U.S.C. 154(b) by 595 days.

(21) Appl. No.: 13/946,997

(22) Filed: Jul. 19, 2013

(65) Prior Publication Data

US 2014/0024984 A1 Jan. 23, 2014

Related U.S. Application Data

(60) Provisional application No. 61/674,246, filed on Jul. 20, 2012.

(51) Int. Cl.
*A61H 15/00* (2006.01)
*A61H 7/00* (2006.01)

(52) U.S. Cl.
CPC ..... *A61H 7/007* (2013.01); *A61H 15/00* (2013.01); *A61H 15/0092* (2013.01);
(Continued)

(58) Field of Classification Search
CPC ..... A61H 15/00; A61H 2015/0007; A61H 2015/0042; A61H 2015/005;
(Continued)

(56) References Cited

U.S. PATENT DOCUMENTS 3,047,140 A 7/1962 Robins
5,531,665 A * 7/1996 Chen ..... A61H 15/00 24/116 A (Continued)

FOREIGN PATENT DOCUMENTS

CN 2070176 U 1/1991
CN 201157514 Y 12/2008
JP 2003-174953 A 6/2003

OTHER PUBLICATIONS

International Preliminary Report on Patentability and Written Opinion for International Application PCT/US2013/051404, dated Jan. 20, 2015; 5 Pages.

(Continued)

*Primary Examiner* — Steven Douglas
(74) *Attorney, Agent, or Firm* — Lewis Roca Rothgerber Christie LLP

(57) ABSTRACT

A massage apparatus is provided to enable an individual to perform a variety of massages by applying targeted pressure to effected muscle groups. In one embodiment, the massage apparatus includes a plurality of generally spherical balls and an oversleeve shrink-fitted over at least a portion of the plurality of balls. The oversleeve includes a first open end and a second open end opposite the first open end. In one embodiment, a method of manufacturing a massage apparatus includes selecting a plurality of balls having a desired density, shape, and outer diameter, arranging the plurality of balls within an oversleeve, and subjecting the oversleeve to heat to longitudinally and radially contract the oversleeve between an original position and a contracted position around at least a portion of the balls.

13 Claims, 5 Drawing Sheets

(52) U.S. Cl.
CPC ..... *A61H 2015/0042* (2013.01); *A61H 2201/1284* (2013.01); *A61H 2205/04* (2013.01); *A61H 2205/06* (2013.01); *A61H 2205/062* (2013.01); *A61H 2205/081* (2013.01); *A61H 2205/106* (2013.01); *A61H 2205/108* (2013.01)

(58) Field of Classification Search
CPC ..... A61H 2015/0064; A61H 15/0092; A61H 7/007; A61H 2201/1284; A61H 2205/04; A61H 2205/06; A61H 2205/062; A61H 2205/081; A61H 2205/106; A61H 2205/108
USPC ..... 601/151, 134; 156/86
See application file for complete search history.

(56) References Cited

U.S. PATENT DOCUMENTS 5,577,995 A * 11/1996 Walker ..... A61H 15/0092 601/118
6,110,131 A * 8/2000 Sleichter, III ..... A61H 1/00 601/57
2004/0006293 A1* 1/2004 Huang ..... A61H 15/00 601/134
2008/0287842 A1* 11/2008 Benson-Gorelick ..... A61H 15/00 601/134
2010/0137763 A1* 6/2010 Dorshow ..... A61H 7/002 601/134
2010/0204625 A1* 8/2010 Yamamoto ..... A61H 1/0292 601/151
2011/0313333 A1* 12/2011 Nicholson ..... A61H 15/0092 601/120
2012/0265106 A1* 10/2012 Accardo ..... A61H 15/0092 601/15
2013/0085426 A1 4/2013 Brodsky
2013/0123676 A1* 5/2013 Fallstich ..... A61H 15/0092 601/118

OTHER PUBLICATIONS

International Search Report and Written Opinion dated Oct. 28, 2013, for International Application No. PCT/US2013/051404 filed Jul. 19, 2013; 12 pages.
Search report issued in Taiwanese patent application No. 103102296, dated Apr. 20, 2017, 1 page.

* cited by examiner

MASSAGER AND METHOD OF MAKING THE SAME

CROSS-REFERENCE TO RELATED APPLICATION(S)

This application claims priority to and the benefit of U.S. Provisional Application Ser. No. 61/674,246, filed Jul. 20, 2012 and titled MASSAGER AND METHOD OF MAKING THE SAME, the entire contents of which are incorporated herein by reference.

TECHNICAL FIELD

The present invention relates generally to therapeutic equipment, and more particularly to a massage apparatus and method of making the same.

BACKGROUND OF THE INVENTION

Individuals commonly suffer muscle strain and fatigue following strenuous workouts. A variety of devices have been developed to treat such muscle strain and fatigue, including motorized massagers and cylindrical foam rollers. These conventional massage devices, however, may be cumbersome to operate and can be difficult to transport. Additionally, complex mechanical massagers may be expensive to produce. Moreover, some conventional massagers may be prohibitively large to target smaller muscle groups, such as the user's hands or feet.

As such, there is a need for a massager device configured to target various muscle groups through localized pressure application. Additionally, there is a need for a massager that is cost effective to manufacture.

SUMMARY OF THE INVENTION

The present disclosure relates generally to therapeutic equipment, and more particularly to a massage apparatus and method of making the same. In one embodiment, the massage apparatus includes a plurality of generally spherical balls and an oversleeve shrink-fitted over at least a portion of the plurality of balls. The oversleeve has a first open end and a second open end opposite the first open end. The massage apparatus may also include end caps enclosing the open ends of the oversleeve. In one embodiment, the oversleeve has at least one tapered neck portion extending between adjacent balls. In one embodiment, a first and second one of the plurality of balls have a diameter larger than a diameter of a third one of the plurality of balls. In one embodiment, the first and second balls each have a diameter of approximately 2.75 inches, and the third ball has a diameter of approximately 1.63 inches. In one embodiment, a first one of the plurality of balls has a diameter larger than a diameter of a second one of the plurality of balls. In one embodiment, the first ball has a diameter of approximately 4 inches, and the second ball has a diameter of approximately 2.75 inches. In one embodiment, at least one of the plurality of balls has a hardness of approximately 40 Shore A. The balls may be formed of any suitable material, such as rubber. The balls may be spaced apart by any suitable distance, such as approximately 0.10 inch. In one embodiment, the oversleeve covers approximately 85% of the surface of the plurality of balls. The oversleeve may be any suitable material, such as polyethylene, polytetrafluoroethylene, or polychloroprene. The oversleeve may have any suitable thickness, such as between approximately 0.05 inch and approximately 0.15 inch. The oversleeve may have any suitable tensile strength, such as greater than approximately 1500 psi.

The present disclosure is also directed to various methods of manufacturing a massage apparatus. In one embodiment, the method of manufacturing a massage apparatus includes selecting a plurality of balls having a desired density, shape, and outer diameter, arranging the plurality of balls within an oversleeve, and subjecting the oversleeve to heat to longitudinally and radially contract the oversleeve between an original position and a contracted position around the plurality of balls. In one embodiment, the heat exceeds approximately 125° Celsius. In one embodiment, the heat is produced from a heat chamber. In a further embodiment, the heat is produced from a dry-air autoclave. In one embodiment, the oversleeve has a heat shrink ratio of approximately 2:1. In one embodiment the heat is applied until a diameter of a neck portion of the oversleeve in the contracted position is approximately twice as small as a diameter of the oversleeve in the original position. In one embodiment, the method includes spacing the plurality of balls apart by any suitable distance, such as approximately 0.1 inch, before subjecting the oversleeve to the heat.

BRIEF DESCRIPTION OF THE DRAWINGS

These and other features and advantages of the present invention will be better understood by reference to the following detailed description when considered in conjunction with the accompanying figures. In the figures, like reference numerals are used throughout the figures to reference like features and components. The figures are not necessarily drawn to scale.

DETAILED DESCRIPTION

The present disclosure relates generally to therapeutic equipment, and more particularly in one embodiment to a massage apparatus configured to eliminate pain in the user's connective muscle tissue and to restore full range of motion in the user's extremities. In general, the massage apparatus of the present disclosure is configured to enable the user to perform a variety of self-administered massages by applying targeted pressure to the user's effected connective muscle tissue. In one embodiment, the massage apparatus is configured to enable the user perform a myofascial release form of soft tissue therapy to treat somatic dysfunction. The myofascial release form of therapy involves the application of gentle sustained pressure into the user's connective muscle tissue to eliminate pain and restore the user's range of motion. Additionally, the massage apparatus is configured to supply accupressure to the desired meridian (i.e., acupoints) of the user to treat the effected part of the user's body associated with that meridian. Furthermore, the massage apparatus is configured to enable the user to perform a trigger point massage to treat a discrete, irritable point in the user's skeletal muscle or fascia associated with a nodule or taut band in the user's muscle fibers. The massage apparatus is also configured to remove lactic acid buildup in the user's muscles, such as after a workout. The massage apparatus of the present disclosure may also be used by one individual to perform a massage on another individual.

The massage apparatuses of the present disclosure are configured to be rolled or slid along the user's muscles, including, for example, the user's forearms, shoulders, back, neck, thighs, or calves. Additionally, the massage apparatuses are configured to apply static pressure against the user's muscles, such as, for instance, when the user places the massage apparatus between the user's lumbar region and a chair or wall and leans back against the chair or wall. The type of massage achieved by the user using the massage apparatus may be determined based on several factors, including the pressure applied to the massage apparatus by the user, the speed with which the user rolls the massage apparatus along the user's muscles, and the configuration of the massage apparatus. The configuration of the massage apparatus is determined by at least the quantity of massage balls, the shape, size, and density of the massage balls, the arrangement of the massage balls, and the density of the oversleeve, described in detail below.

Figure 1A:
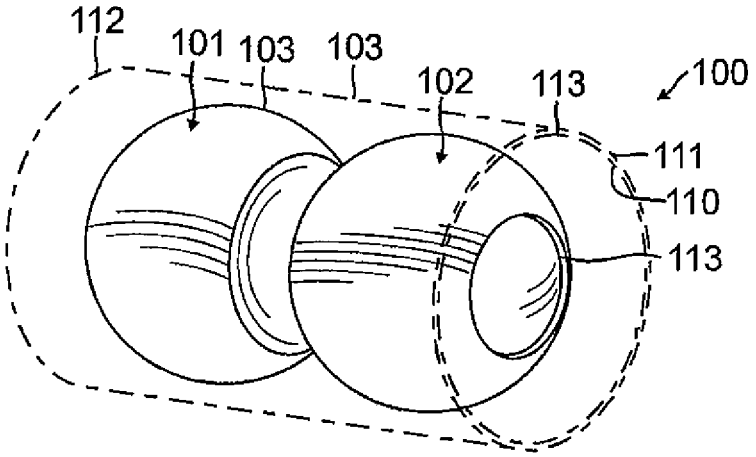
FIG. 1A is a perspective view of a massage apparatus having two similarly sized massage balls, according to one embodiment of the present disclosure.
Figure 1B:
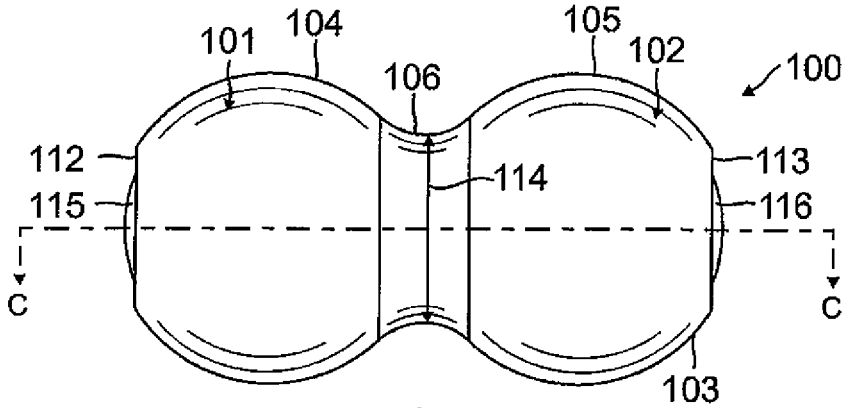
FIG. 1B is a side view of the embodiment of the massage apparatus illustrated in FIG. 1A.
Figure 1C:
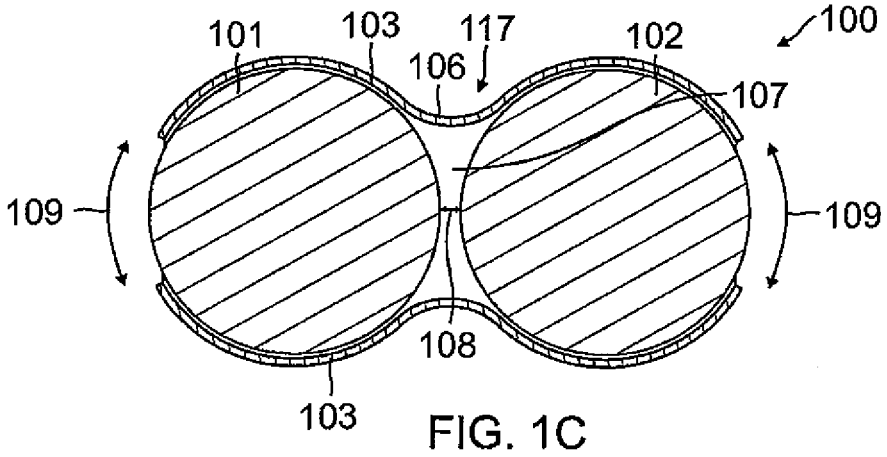
FIG. 1C is a cross-sectional view of the embodiment of the massage apparatus shown in FIG. 1B taken along line C-C.

Referring now to an embodiment of the present disclosure shown in FIGS. 1A-1C, the massage apparatus 100 comprises two massage balls 101, 102 joined by an oversleeve 103. In the illustrated embodiment, the massage apparatus 100 forms a substantially hour-glass shape wherein the oversleeve 103 tapers down between relatively wider portions 104, 105 and a relatively narrower neck portion 106. The narrower neck portion 106 is formed by the portion of the oversleeve 103 spanning between the two adjacent massage balls 101, 102. The neck portion 106 of the oversleeve 103 forms a substantially U-shaped channel 117 configured to conform to the contours of the user's various muscle groups. As shown in FIG. 1C, an annular wedge-shaped gap 107 is formed between the neck portion 106 of the oversleeve 103 and portions of the two massage balls 101, 102. The annular gap 107 is configured to permit the massage balls 101, 102 to flex (arrow 109) about the neck portion 106 of the oversleeve 103, such as, for example, during a massage. The flexing (arrow 109) of the massage balls 101, 102 about the neck portion 106 is configured to enable the massage apparatus 100 to conform to the unique shape of the user's body. It will be appreciated, however, that the massage apparatus 100 may be configured such that the massage balls 101, 102 are rigidly fixed in the oversleeve 103 and still fall within the scope and spirit of the present disclosure (i.e., the massage balls 101, 102 may be configured not to flex about the neck portion 106 of the oversleeve 103). The massage apparatus 100 may be configured not to permit the massage balls 101, 102 to flex (arrow 109) about the neck portion 106 of the oversleeve 103 by, for example, selecting an oversleeve 106 having a sufficiently rigid material and/or thickness, and/or by eliminating or minimizing the gap 107 between the massage balls 101, 102 and the oversleeve 103.

With continued reference to the embodiment of the massage apparatus 100 illustrated in FIGS. 1A-1C, during assembly of the massage apparatus 100, the oversleeve 103 is configured to radially and longitudinally contract from an original position (shown in dashed lines in FIG. 1A) to a contracted position (shown in solid lines) around the exercise balls 101, 102. In the contracted position, the oversleeve 103 substantially conforms to the contour of a portion of the outer surfaces of the massage balls 101, 102. In one embodiment, the oversleeve 103 is configured to radially and longitudinally contract between the original position and the contracted position when the original oversleeve 103 is exposed to a heat source, as described in detail below. In one embodiment, the temperature of the heat source necessary to contract the oversleeve 103 substantially corresponds to the melting point of the material composition of the oversleeve 103.

In the original position, the oversleeve 103 is a thin-walled cylindrical member having an inner diameter 110 and an outer diameter 111 (i.e., prior to contraction of the oversleeve 103, the oversleeve 103 is a tubular member having an inner diameter 110 and an outer diameter 111). The original oversleeve 103 also has openings 112, 113 on opposite ends. The open ends 112, 113 of the original oversleeve 103 are configured to receive the massage balls 101, 102 during assembly of the massage apparatus 100, as described in detail below. The radial and longitudinal contraction of the oversleeve 103 is configured to retain the massage balls 101, 102 in the contracted oversleeve 103 (i.e., the contracted oversleeve 103 is configured to prevent the massage balls 101, 102 from being inadvertently dislodged). In one embodiment, the oversleeve 103 is configured to contract to half its original diameter 110, 111 (i.e., a shrink ratio of 2:1). The oversleeve 103 may have any other suitable shrink ratio, such as, for example, between approximately 4:1 and approximately 3:2 and still fall within the scope and spirit of the present disclosure. In one embodiment of the massager apparatus 100, the outer diameter 111 of the original oversleeve 103 is approximately twice as large as the diameter 114 of the neck portion 106 of the contracted oversleeve 103. It will be appreciated, however, that the outer diameter 111 of the original (i.e., uncontracted) oversleeve 103 may have any other suitable size relative to the diameter 114 of the neck portion 106 of the contracted oversleeve 103 (e.g., the outer diameter 111 of the original oversleeve may be between approximately 10% and approximately 150% larger than the diameter of the neck portion 106). The appropriate outer diameter 111 of the original oversleeve 103 is determined by the diameter of the largest massage ball 101, 102 in the massage apparatus 100 and the shrink ratio of the over-sleeve 103. In one embodiment, the outer diameter 111 of the original oversleeve 103 should be approximately slightly larger than the diameter of the largest massage ball 101, 102. For instance, in an embodiment in which the massage balls 101, 102 have an outer diameter of approximately 2¾ inches and the oversleeve 103 has a shrink ratio of 2:1, an oversleeve 103 having an original outer diameter 111 of approximately 3 inches may be used. In an alternate embodiment, the outer diameter 111 of the original oversleeve 103 may be approximately 50% larger than the diameter of the largest massage ball 101, 102 in the massage apparatus 100.

In the illustrated embodiment of FIGS. 1A-1C, exposed portions 115, 116 of the massage balls 101, 102, respectively, are uncovered by the open ends 112, 113 of the contracted oversleeve 103. The exposed portions 115, 116 of the massage balls 101, 102 are configured to extend through the open ends 112, 113 of the contracted oversleeve 103. The contracted oversleeve 103 is configured to cover between approximately 50% and 95% of the outer surfaces of the massage balls 101, 102. In one embodiment, the contracted oversleeve 103 is configured to cover between approximately 70% and 90% of the outer surfaces of the massage balls 101, 102. In another embodiment, the contracted oversleeve 103 is configured to cover approximately 90% of the outer surfaces of the massage balls 101, 102. It will be appreciated, however, that the invention described herein is not limited to the coverage area described above, and the proportion of the massage balls 101, 102 covered by the oversleeve 103 may be varied to increase or decrease the force necessary to dislodge the massage balls 101, 102 from the contracted oversleeve 103. Additionally, in one embodiment, the exposed portions 115, 116 of the massage balls 101, 102, respectively, may be enclosed by end caps, such as substantially circular thin-wall members. The end caps may be connected to the exposed ends 115, 116 of the massage balls 101, 102 by any suitable means, such as bonding, adhering, welding, or fastening.

In one embodiment, the thickness of the oversleeve 103 may be between approximately 0.05 inch and approximately 0.15 inch. In another embodiment, the thickness of the oversleeve 103 may be between approximately 0.08 inch and approximately 0.125 inch. In another embodiment, the thickness of the oversleeve 103 may be approximately 0.10 inch. It will be appreciated, however, that the thickness of the oversleeve 103 may be varied to achieve greater or lesser stiffness of the massage apparatus 100. In one embodiment, it may be preferable to provide an oversleeve 103 having a relatively thin wall (e.g., approximately 0.05 inch) to enable the massage apparatus 100 to flex (arrow 109) to conform to the shape of the user's body while performing a massage. In one or more alternate embodiments, it may be preferable to provide an oversleeve 103 having a relatively thick wall (e.g., approximately 0.25 inch) to prevent or minimize the massage apparatus 100 from flexing, such that the user may, for instance, apply greater pressure during a massage. The oversleeve 103 may be formed from an elastomer or thermoplastic material, such as polyethylene, polytetrafluoroethylene (PTFE), or polychloroprene heat shrink tubing. The oversleeve 103 may be formed by any suitable process, such as extruding or rapid prototyping using additive manufacturing.

With continued reference to the illustrated embodiment of FIGS. 1A-1C, the massage balls 101, 102 are spaced apart by a gap 108 (e.g., between approximately 0.10 inch and 0.25 inch). In general, spacing the massage balls 101, 102 apart increases the flexibility of the massage apparatus 100 to conform to the contours of the user's various muscle groups. Specifically, the gap 108 between the massage balls 101, 102 tends to enable the massage apparatus 100 to flex (arrow 109) about the neck portion 106 of the over-sleeve 103 during a massage. In an alternate embodiment, the massage balls 101, 102 may abut each other, or may even be compressed against one another. In general, closer spacing between the massage balls 101, 102 tends to increase the flexural strength of the massage apparatus 100.

The massage balls 101, 102 may have any suitable outer diameter, such as, between approximately ½ inch and approximately 6 inches. In one embodiment, the massage balls 101, 102 have an outer diameter of approximately 3 15/16 inches. In another embodiment, the massage balls 101, 102 have an outer diameter of approximately 2¾ inches. In a further embodiment, the massage balls 101, 102 have an outer diameter of approximately 1⅝ inches. In yet another embodiment, the massage balls 101, 102 have an outer diameter of approximately 5⅛ inches.

Figure 2A:
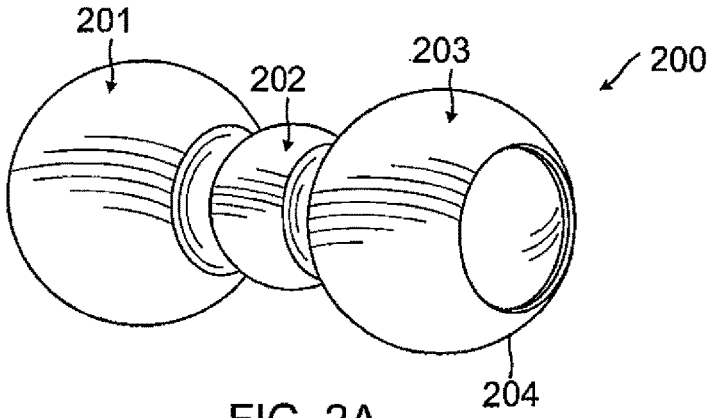
FIG. 2A is a perspective view a massage apparatus having three massage balls, according to one embodiment of the present disclosure.
Figure 2B:
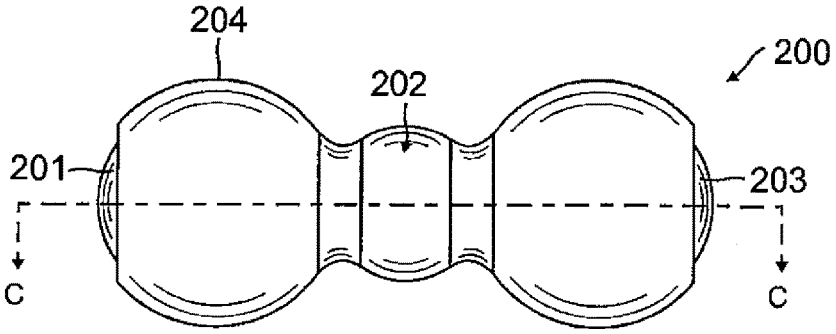
FIG. 2B is a side view of the embodiment of the massage apparatus illustrated in FIG. 2A.
Figure 2C:
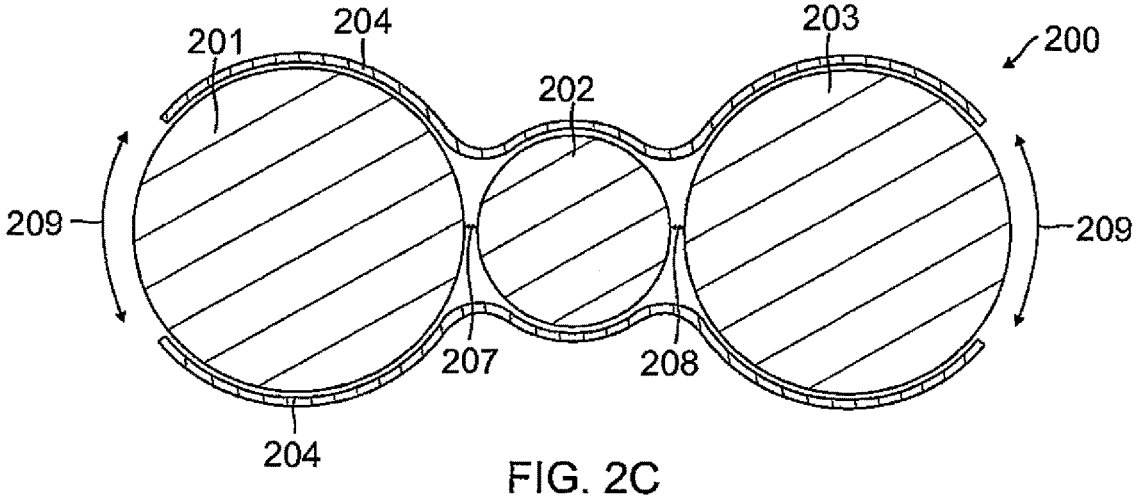
FIG. 2C is a cross-sectional view of the embodiment of the massage apparatus shown in FIG. 2A taken along line C-C.

Although the massage apparatus 100 has been described with reference to two massage balls 101, 102, the massage apparatus 100 may include more than two massage balls 101, 102 and still fall within the scope and spirit of the present invention. Providing more than two massage balls advantageously permits the user to target different muscle groups. For instance, in the embodiment illustrated in FIGS. 2A-2C, the massage apparatus 200 is comprised of three massage balls 201, 202, and 203 joined by a contracted oversleeve 204. The massage apparatus 200 having three massage balls 201, 202, and 203 may be especially adapted to apply a massage to the user's hands or feet, although the massage apparatus 200 is not limited to such uses. Furthermore, the diameter of the massage balls 201, 202, and 203 may vary. In the illustrated embodiment, the center massage ball 202 is substantially smaller than the two outermost massage balls 201, 203. The massage balls 201, 202, and 203 may abut each other, or they may be spaced apart by gaps 207, 208. In one embodiment, the gap 207 between the first outermost massage ball 201 and the center massage ball 202 may be different than the gap 208 formed between the second outermost massage ball 203 and the center massage ball 202. It will be appreciated, however, that the gaps 207, 208 may be substantially the same. As described above in reference to the massage apparatus 100, the gaps 207, 208 between the massage balls 201, 202, and 203 may be varied to achieve the desired flexibility (arrow 209) of the massage apparatus 200 about a neck portion 206 of the oversleeve 204. In one embodiment of the massager apparatus 200, the center massage ball 202 may have an outer diameter of approximately 1⅝ inch, and the two outermost massage balls 201, 203 may have an outer diameter of approximately 2¾ inches. The center massage ball 202 and the two outermost massage balls 201, 203 may have any other suitable outer diameters and still fall within the scope and spirit of the present disclosure. For instance, the center massage ball 202 may have an outer diameter between approximately 0.5 inch and approximately 4 inches, and the two outermost massage balls 201, 203 may have an outer diameter between approximately 0.75 inch and approximately 6 inches. Additionally, although in the illustrated embodiment the two outermost massage balls 201, 203 are larger than the center massage ball 202, the massage balls 201, 202, 203 may have any other relative sizes (e.g., the center massage ball 202 may be larger than the two outermost massage balls 201, 203 or all three massage balls 201, 202, 203 may have substantially the same size). Additionally, although in the illustrated embodiment the two outermost massage balls 201, 203 are the same or substantially the same size as each other, one of the outermost massage balls 201 may have different size than the other outermost massage ball 203.

Figure 3A:
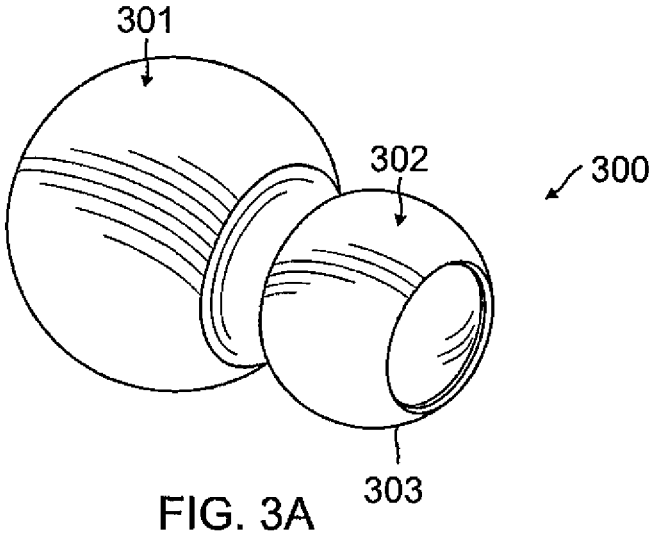
FIG. 3A is a perspective view of a massage apparatus having two massage balls with different diameters, according to one embodiment of the present disclosure.
Figure 3B:
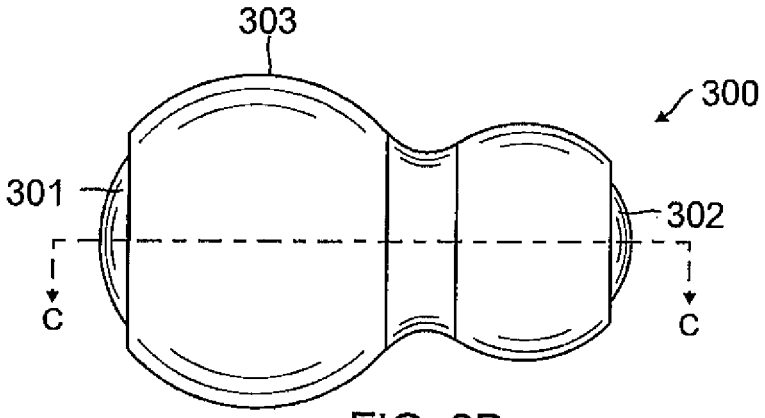
FIG. 3B is a side view of the embodiment of the massage apparatus illustrated in FIG. 3A.
Figure 3C:
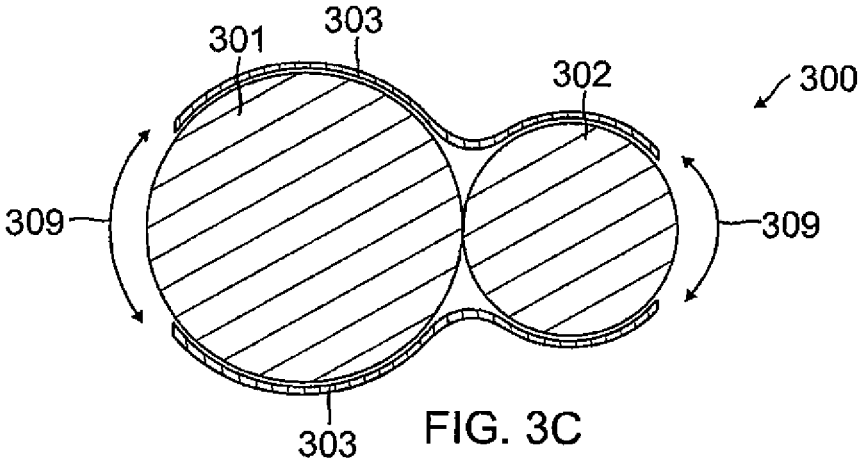
FIG. 3C is a cross-sectional view of the embodiment of the massage apparatus shown in FIG. 3A taken along line C-C.

Referring now to the embodiment illustrated in FIGS. 3A-3C, the massage apparatus 300 is comprised of two massage balls 301, 302 joined by a contracted oversleeve 303. In this illustrated embodiment, the massage apparatus 300 includes a relatively larger massage ball 301 and a relatively smaller massage ball 302. The embodiment of the massage apparatus 300 illustrated in FIGS. 3A-3C may be adapted for the user to grip the larger ball 301 and then press the relatively smaller ball 302 into the targeted muscle group, or vice versa, although the massage apparatus 300 is not limited to such uses. In the illustrated embodiment of the massager apparatus 300, the larger ball 301 abuts the relatively smaller ball 302. It is contemplated, however, that a gap may be formed between the larger ball 301 and the relatively smaller ball 302 to achieve the desired flexibility (arrow 309) of the massager apparatus 300, substantially as described above. In one embodiment of the massage apparatus 300, the relatively larger massage ball 301 may have a diameter of 3 15/16 inches, and the relatively smaller massage ball 302 may have a diameter of 2¾ inches. In an alternate embodiment of the massager apparatus 300, the larger massage ball 301 may have an outer diameter of approximately 5⅛ inch, and the smaller massage ball 302 may have an outer diameter of approximately 3 15/16 inches. It will be appreciated, however, that the massage balls 301, 302 of the massage apparatus 300 may have any other suitable outer diameters.

With reference now to the various embodiments of the massage apparatuses 100, 200, 300 illustrated in FIGS. 1A-1C, 2A-2C, and 3A-3C, the massage balls (101, 102 in FIGS. 1A-1C; 201, 202, 203 in FIGS. 2A-2C; and 301, 302 in FIGS. 3A-3C) are substantially spherical and have a substantially smooth outer surface. In the illustrated embodiments, the massage balls are solid, although in alternate embodiments the massage balls may be comprised of a thin-walled spherical shell having a hollow inner portion. In an alternate embodiment, the outer surface of the massage balls may include protruding features, such as ridges, nodes, or a knurled surface, to facilitate a desired type of massage. Additionally, although the massage balls have been described as substantially spherical, the massage balls may have other shapes (e.g., ovoid) and still fall within the spirit and scope of the present disclosure.

The massage balls (101, 102 in FIGS. 1A-1C; 201, 202, 203 in FIGS. 2A-2C; and 301, 302 in FIGS. 3A-3C) of the present disclosure may be formed from any suitably durable and compressible material, such as natural rubber, polychloroprene, or sponge rubber. In one embodiment, the massage balls have a hardness of approximately 7 Shore OO, according to a standard durometer test performed according to ASTM International Standard D2240. In another embodiment, the massage balls have a hardness of approximately 20 Shore A. In yet another embodiment, the massage balls have a hardness of approximately 40 Shore A. It will be appreciated, however, that the hardness of the material comprising the massage balls may vary to achieve the desired performance characteristics of the massage apparatus 100, 200, 300. In general, harder massage balls are configured to apply greater pressure to the user's muscle tissue, whereas relatively softer massage balls are configured to apply lighter pressure. Additionally, in general, embodiments of the massage apparatuses 100, 200, 300 having larger massage balls are configured to target the user's larger muscle groups, such as legs, hips, or buttocks, whereas embodiments of the massage apparatuses having relatively smaller balls are configured to target the user's smaller muscle groups, such calves, shoulders, or neck, although use of the various embodiments of the massage apparatuses 100, 200, 300 is not limited to such uses. The massage balls may be formed from any suitable process, including molding, stamping, pressing, or machining. Additionally, the massage balls may be comprised of existing balls, such as tennis balls, racquetballs, golf balls, softballs, or any other suitable existing balls.

The oversleeves (103 in FIGS. 1A-1C; 204 in FIGS. 1A-1C; and 303 in FIGS. 3A-3C) of the present disclosure may be formed of any suitable material, such as, for example, an elastomer or thermoplastic material (e.g., polyethylene, polytetrafluoroethylene (PTFE), or polychloroprene heat shrink tubing), or any combinations thereof. Additionally, the oversleeves 103, 204, 303 may have any suitable thickness, such as, for example, between approximately 0.05 inch and approximately 0.25 inch, although it will be appreciated that the oversleeves 103, 204, 303 may be thinner than 0.05 inch or thicker than 0.25 inch and still fall within the scope and spirit of the present disclosure. The oversleeves 103, 204, 303 may have any suitable tensile strength. In one example embodiment, the oversleeves 103, 204, 303 have a tensile strength greater than approximately 1500 psi. It will be appreciated, however, that the oversleeves 103, 204, 303 may have a tensile strength less than or equal to approximately 1500 psi and still fall within the scope and spirit of the present disclosure. Moreover, the oversleeves 103, 204, 303 may any suitable ultimate tensile elongation (i.e., the percentage increase in length that occurs before the oversleeve breaks under tension), such as, for example, greater than approximately 200%, although it will be appreciated that the oversleeves 103, 204, 303 may have an ultimate tensile elongation less than or equal to approximately 200% and still fall within the scope and spirit of the present disclosure.

Additionally, the oversleeves 103, 204, 303 may any suitable secant modulus of elasticity (i.e., an approximate modulus of elasticity of the oversleeves in the non-linear range of the stress-strain curve), such as, for example, less than approximately $2.5\times10^4$ psi, although it will be appreciated that the oversleeves 103, 204, 303 may have a secant modulus of elasticity greater than or equal to approximately $2.5\times10^4$ psi and still fall within the scope and spirit of the present disclosure. Furthermore, the oversleeves 103, 204, 303 may have any suitable specific gravity, such as, for example, approximately 1.35, although it will be appreciated that the oversleeves 103, 204, 303 may have a specific gravity greater than or less than 1.35 and still fall within the scope and spirit of the present disclosure. The oversleeves 103, 204, 303 of the present disclosure may have any suitable shrink ratio, such as, for example, approximately 2:1, although the oversleeves 103, 204, 303 may have shrink ratio greater than or less than 2:1 and still fall within the scope and spirit of the present disclosure. The oversleeves 103, 204, 303 may also have any suitable longitudinal contraction (i.e., the percentage change in the length of the oversleeves between the original and contracted positions), such as, for example, approximately −5%, although the oversleeves 103, 204, 303 may have a longitudinal contraction of greater than or less than −5% and still fall within the scope and spirit of the present disclosure.

Figure 4A:
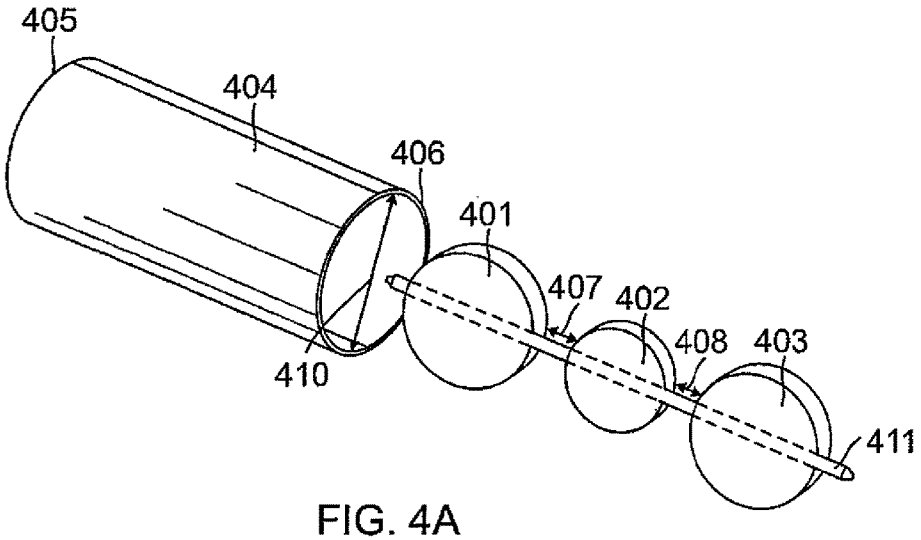
FIG. 4A is a perspective view illustrating a series of massage balls being inserted into an oversleeve during one or more tasks of a method of manufacturing a massage apparatus according to the present disclosure.

With reference now to FIG. 4A, the various embodiments of the massage apparatuses 100, 200, 300 are configured to be manufactured by first selecting the desired quantity, density, and outer diameters of the massage balls. In the illustrated embodiment of FIG. 4A three massage balls 401, 402, 403 have been selected, wherein the two outermost massage balls 401, 403 have a larger diameter than the center massage ball 402. It will be appreciated, however, that any other suitable number of massage balls may be selected, such as, for instance, between two and five. Additionally, the massage balls may have any suitable outer diameters, and the massage balls may have substantially the same outer diameter or different outer diameters. The user then selects an original oversleeve 404 having the appropriate diameter 410 given the heat shrink ratio of the oversleeve 404 and the outer diameters of the massage balls 401, 402, 403. The user then inserts the massage balls 401, 402, 403 with the desired arrangement into one or both of the open ends 405, 406 of the original oversleeve 404. In one embodiment, the massage balls 401, 402, 403 are arranged such that the relatively smaller massage ball 402 is bounded on opposite sides by the two larger massage balls 401, 403. In an alternate embodiment, the massage balls 401, 402, 403 may be arranged with the two larger massage balls 401, 403 adjacent to each other, and the smaller massage ball 402 adjacent to one of the larger massage balls 401, 403. Additionally, in one or more alternate embodiments, the massage apparatus may include two massage balls having substantially the same diameter, as illustrated in FIGS. 1A-1C, or different diameters, as illustrated in FIGS. 3A-3C.

With continued reference to FIG. 4A, the user then sets the gaps 407, 408 between adjacent massage balls 401, 402, 403 to achieve the desired flexibility of the massager apparatus. In one embodiment, the gaps 407, 408 may be selected such that each massage ball abuts an adjacent massage ball (i.e., there may be no gaps between adjacent massage balls). Additionally, the gaps 407, 408 may be selected such that massage balls 401, 402, 403 are compressed against each other. In general, the greater the gap 407, 408 between adjacent massage balls 401, 402, 403, the greater the flexibility of the massage apparatus. In one embodiment, a thin rod 411 may extend through the massage balls 401, 402, 403 along the longitudinal direction of the massage apparatus to set the desired gap 407, 408 between the massage balls 401, 402, 403 during the assembly process. That is, the thin rod 411 may extend through the massage balls 401, 402, 403, and the user may slide the massage balls 401, 402, 403 along the rod 411 to achieve the desired gaps 407, 408 between the massage balls 401, 402, 403. The gaps 407, 408 between the massage balls 401, 402, 403 may be set before or after the massage balls 401, 402, 403 are inserted into one of the open ends 405, 406 of the oversleeve 404. The rod 411 may be removed after the oversleeve 404 has contracted around the massage balls 401, 402, 403, as described below. The open ends 405, 406 of the oversleeve 404 facilitate the installation and removal of the thin rod 411 through the massage balls 401, 402, 403. In an alternate embodiment, spacers may be used to set the gaps 407, 408 between adjacent massage balls 401, 402, 403. The spacers may be composed of a material configured to dissolve or degrade with the application of a heat source 409 (FIG. 4B) used to contract the oversleeve 404 around the massage balls 401, 402, 403.

Figure 4B:
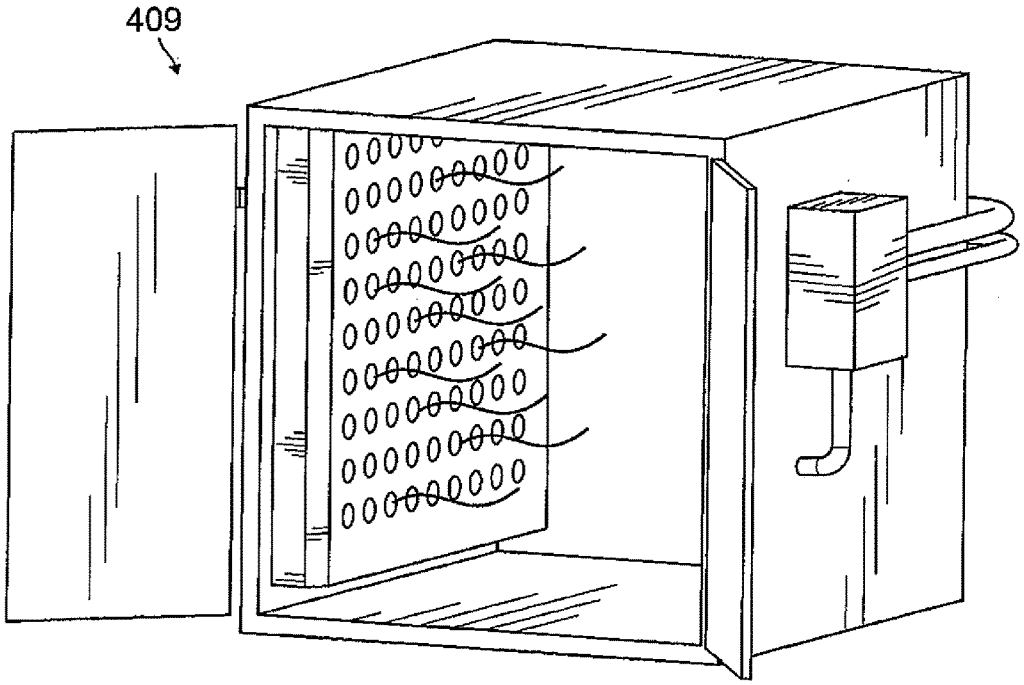
FIG. 4B is a perspective view of a heat source configured to contract an oversleeve into a contracted position around a series of massage balls during one or more tasks of a method of manufacturing a massage apparatus according to the present disclosure.

With reference now to FIG. 4B, the user then subjects the plurality of massage balls 401, 402, 403 and the original oversleeve 404 to a substantially uniform heat source 409. The heat source 409 may be supplied by any suitable means, such as a heat chamber, a dry-air autoclave, hand torches, or hot air guns. The heat source 409, according to one embodiment, is applied substantially uniformly to the original oversleeve 404 until the oversleeve 404 radially and longitudinally contracts the desired amount (up to the shrink ratio) around the massage balls 401, 402, 403. In one embodiment, the heat source 409 is applied until the oversleeve 404 substantially conforms to the contours of the massage balls 401, 402, 403 and thereby secures the massage balls 401, 402, 403 in the contracted oversleeve 404. In one embodiment, the oversleeve 404 does not begin to radially and longitudinally contract until the heat source 409 achieves a temperature of approximately 125° Celsius. In general, the temperature at which the oversleeve 404 contracts is approximately the melting point of the material composition of the oversleeve 404. Accordingly, the material of the oversleeve 404 may be selected such that the oversleeve 404 begins to radially and longitudinally contract at a desired temperature. In the embodiment in which the thin rod 411 is used to set the gaps 407, 408 between the massage balls 401, 402, 403, the thin rod 411 may be removed following application of the heat source 409. In an alternate embodiment, the various embodiments of the massage apparatuses 100, 200, 300 may be formed by dipping the plurality of massage balls 401, 402, 403 into a liquid bath or by spraying or brushing a coating over the plurality of massage balls 401, 402, 403 to achieve an oversleeve securing the massage balls 401, 402, 403 together. The coating is then hardened by, for example, heating and/or drying, to form the oversleeve 404.

Figure 5:
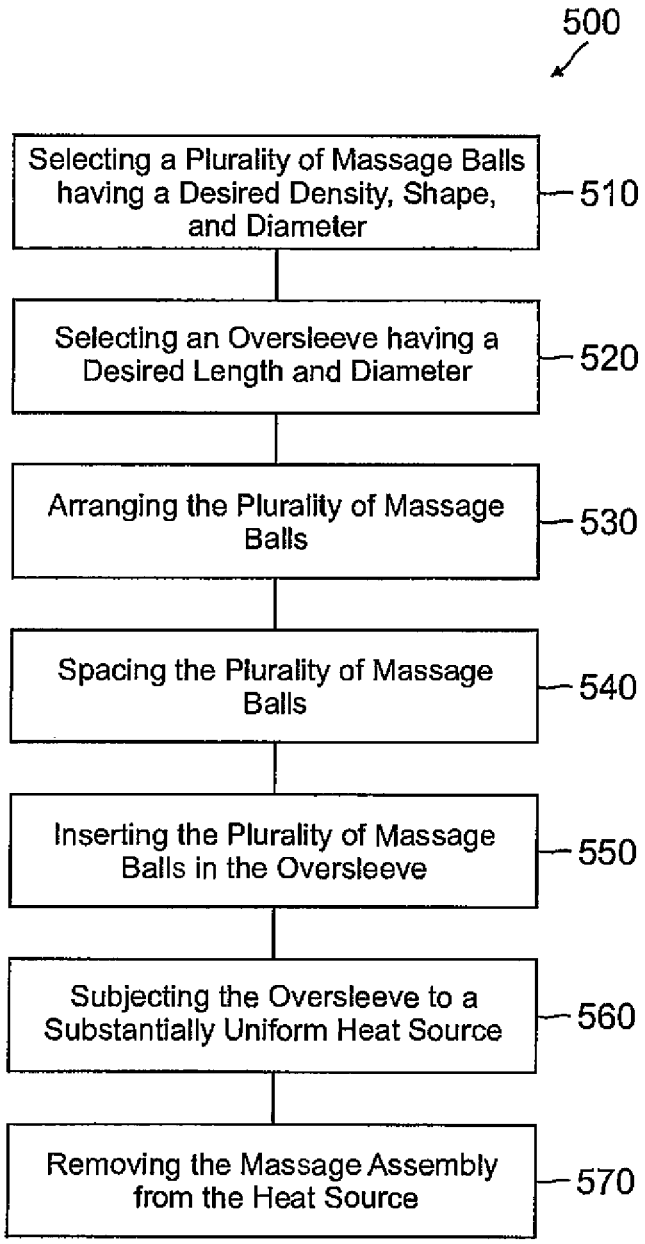
FIG. 5 is a flowchart illustrating tasks of manufacturing a massage apparatus according to one method of the present disclosure.

With reference now to FIG. 5, a method 500 of manufacturing a massage apparatus 100, 200, 300 will now be described. In one embodiment, the method 500 includes a task 510 of selecting a plurality of massage balls having a desired density, shape, and diameter. The method 500 also includes a task 520 of selecting an oversleeve having a desired length and diameter. The desired length and diameter of the oversleeve may be determined based upon a variety of factors, including the shrink ratio of the oversleeve, the diameter of the massage balls, the desired coverage area of the massage balls, and the desired force necessary to dislodge the massage balls from the oversleeve. In one embodiment, the method 500 includes a task 530 of arranging the massage balls (e.g., arranging a relatively smaller massage ball between two relatively larger massage balls). In one embodiment, the method 500 may also include a task 540 of spacing the massage balls apart from each other. As described above, each massage ball may abut an adjacent massage ball or may be spaced apart by a gap (e.g., between approximately 0.10 inch and 0.25 inch). As described above, the task 540 of spacing the massage balls may comprise inserting a rod through the plurality of massage balls and then sliding the massage balls along the rod to achieve the desired gaps between adjacent massage balls. Alternately, the task 540 may include placing spacers between adjacent massage balls. In another embodiment, the task 540 may include manually maintaining the gaps between the adjacent massage balls. The task 540 of spacing apart the massage balls may be performed by any other suitable means. With continued reference to FIG. 5, the method 500 includes, in one embodiment, a task 550 of inserting the plurality of massage balls into one or both of the open ends of the oversleeve. The method 500 also includes the task 560 of subjecting the oversleeve to a generally uniform heat source (e.g., the heat chamber 409 shown in FIG. 4B) until the oversleeve contracts around the massage balls. The method 500 also includes a task 570 of removing the massage apparatus 100, 200, 300 from the heat source after the oversleeve has sufficiently contracted around the massage balls. It will be appreciated that the oversleeve may be contracted by any amount, up to and including the shrink ratio of the oversleeve.

While in one embodiment, the method 500 of manufacturing a massage apparatus 100, 200, 300 may include each of the tasks described above and shown in FIG. 5, in other embodiments of the present invention, in a method of manufacturing a massage apparatus 100, 200, 300, one or more of the tasks described above and shown in FIG. 5 may be absent and/or additional tasks may be performed. Further, in the method 500 of manufacturing the massage apparatus 100, 200, 300 according to one embodiment, the tasks may be performed in the order depicted in FIG. 5. However, the present disclosure is not limited thereto and, in a method of manufacturing a massage apparatus 100, 200, 300 according to other embodiments of the present disclosure, the tasks described above and shown in FIG. 5 may be performed in any other suitable sequence. For example, in one embodiment, the task 540 of spacing the plurality of massage balls is performed before task 550 of inserting the plurality of massage balls in the oversleeve, while in an alternate embodiment, the task 550 of inserting the plurality of massage balls in the oversleeve is performed before the task 540 of spacing the plurality of massage balls.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the device in addition to the orientation depicted in the figures. Additionally, although the massage apparatuses of the present disclosure have been described with reference to performing various massage techniques, it will be appreciated that the massage apparatuses of the present disclosure are not limited to such uses. Furthermore, as used herein, the term "substantially" and similar terms are used as terms of approximation and not as terms of degree, and are intended to account for the inherent deviations in measured or calculated values that would be recognized by those of ordinary skill in the art.

What is claimed is:

1. A method of manufacturing a massage apparatus comprising a plurality of balls and an oversleeve, the method comprising:

selecting the plurality of balls having a desired density, shape, and outer diameter;

arranging the plurality of balls within the oversleeve; and subjecting the oversleeve to heat to longitudinally and radially contract the oversleeve between an original position and a contracted position around at least a portion of the plurality of balls, wherein at least one of said plurality of balls is not in direct contact with another of said plurality of balls that is closest to said at least one of said plurality of balls.

2. The method of claim 1, wherein the heat exceeds approximately 125° Celsius.

3. The method of claim 1, wherein the heat is produced from a heat chamber.

4. The method of claim 1, wherein the heat is produced from a dry-air autoclave.

5. The method of claim 1, wherein the outer diameter of a first ball of the plurality of balls is greater than the outer diameter of a second ball of the plurality of balls.

6. The method of claim 1, wherein the oversleeve comprises polyethylene.

7. The method of claim 1, wherein the oversleeve has a heat shrink ratio of approximately 2:1.

8. The method of claim 1, wherein a hardness of at least one of the plurality of balls is approximately 40 Shore A.

9. The method of claim 1, further comprising spacing the plurality of balls apart before subjecting the oversleeve to the heat.

10. The method of claim 1, wherein the oversleeve is comprised of a material selected from the group of materials consisting of polyethylene, polytetrafluoroethylene, and polychloroprene.

11. A method of manufacturing a massage apparatus comprising a plurality of balls and an oversleeve, the method comprising:

selecting the plurality of balls having a desired density, shape, and outer diameter;

arranging the plurality of balls within the oversleeve; and subjecting the oversleeve to heat to longitudinally and radially contract the oversleeve between an original position and a contracted position around at least a portion of the plurality of balls, wherein the outer diameter of a first ball of the plurality of balls is greater than the outer diameter of a second ball of the plurality of balls.

12. The method of claim 11, wherein the oversleeve is comprised of a material selected from the group of materials consisting of polyethylene, polytetrafluoroethylene, and polychloroprene.

13. A method of manufacturing a massage apparatus comprising a plurality of balls and an oversleeve, the method comprising:

selecting the plurality of balls having a desired density, shape, and outer diameter;

arranging the plurality of balls within the oversleeve; and subjecting the oversleeve to heat to longitudinally and radially contract the oversleeve between an original position and a contracted position around at least a portion of the plurality of balls, wherein the heat is applied until a diameter of a neck portion of the oversleeve in the contracted position is not greater than half of a diameter of the oversleeve in the original position.

* * * * *